United States Patent [19]

Zöllner et al.

[11] Patent Number: 4,531,219

[45] Date of Patent: Jul. 23, 1985

[54] ELECTRODE ASSEMBLY FOR ARC FURNACES

[75] Inventors: Dieter Zöllner; Inge Lauterbach-Dammler, both of Nuremberg; Thomas Taube, Erlangen; Hans Lades, Schwaig; Siegfried Liebel, Röthenbach; Hanns-Georg Bauer, Witten, all of Fed. Rep. of Germany

[73] Assignee: ARC Technologies Systems Ltd., Cayman Islands

[21] Appl. No.: 519,045

[22] Filed: Aug. 1, 1983

[30] Foreign Application Priority Data

Aug. 26, 1982 [CH] Switzerland ..... 5069/82

[51] Int. Cl.[3] ..... H05B 7/101

[52] U.S. Cl. ..... 373/101

[58] Field of Search ..... 373/94, 96, 99, 101, 373/100, 93

[56] References Cited

U.S. PATENT DOCUMENTS

| | | | |
|---|---|---|---|
| 871,338 | 11/1907 | Heroult | 373/101 |
| 3,457,355 | 7/1969 | Guerrieri | 373/101 |
| 3,717,445 | 2/1973 | Yoshimura et al. | 373/94 |
| 3,804,966 | 4/1974 | Winter | 373/101 |
| 4,182,927 | 1/1980 | Phillips | 13/16 |
| 4,323,717 | 4/1982 | Garner | 373/101 |

FOREIGN PATENT DOCUMENTS

| | | |
|---|---|---|
| 2363958 | 3/1978 | France . |
| 122034 | 2/1919 | United Kingdom . |

*Primary Examiner*—G. P. Tolin
*Assistant Examiner*—Greg Thompson
*Attorney, Agent, or Firm*—John J. Freer

[57] ABSTRACT

To provide an axially variable means of fixation, an electrode for electric arc furnaces is held via a spacing means comprising radially movable contact elements and metallic spacers. The contact elements may be pressed radially inwards against the electrode by means of clamping jaws, thus constituting a solid mechanical and electrical contact between the electrode clamp and the electrode proper.

10 Claims, 4 Drawing Figures

ELECTRODE ASSEMBLY FOR ARC FURNACES

FIELD OF THE INVENTION

The invention relates to an electrode assembly for arc furnaces. More particularly, this invention relates to clamping means for the electrode that includes a spacing means arranged between the electrode and the clamping means and wherein the electrode includes an upper shaft portion surrounded by said spacing means.

BACKGROUND OF THE INVENTION

British patent application No. 2082028 describes a clamping device for arc furnace electrodes which includes three clamping jaws (2) for radially surrounding an electrode, each jaw spanning a 120° arc, and having axial grooves (10) in which graphite bars (8) are arranged. By pressing the clamping jaws (2) the graphite bars (8) are pressed against the body of the electrode (6), establishing mechanical and electrical contact therebetween.

Referring to FIG. 2 of British application No. 2082028, the graphite bars (8) have a length which is many times their diameter. Often under usual contact pressures, the risk of breakage for these long, thin graphite bars is relatively high.

As long as the electrode (6) as shown in British application No. 2082028 is in a clamped position, it does not matter whether the graphite bars are still intact or whether they have broken. However, if clamping is released and the electrode subsequently mounted again, problems may arise as broken parts may wedge. As a consequence, the contact between the graphite bars and the electrode will considerably deteriorate.

A further drawback of clamping device, typical of those shown in British application No. 2082028 is that each individual graphite bar has to be affixed to one of the clamping jaws in a relatively complicated manner illustrated in FIGS. 2 and 3. Furthermore, the great number of contact areas between clamping jaws and graphite bars on one hand and between the latter and the electrode body on the other can have an unfavourable effect upon current conduction.

Due to the fact that the graphite bars may break it is practically impossible to change the place of clamping between clamping jaws and electrode, for if the clamping jaws are released there is the danger that any broken parts will become wedged.

European patent application No. 75534, corresponding to U.S. Pat. No. 4,446,561, describes an electrode having graphite segments along its periphery at two axially moved clamping positions which are firmly connected to the metal shaft of the electrode.

One purpose of the graphite segments is to prevent direct contact between the metallic clamping jaws and the upper shaft of the electrode, as far as such jaws and shaft consist of metal, since such contact would lead to weld connections during operation and, consequently, to a rigid connection between the electrode and the support arm.

While the proposal put forth in European publication No. 75534 is satisfactory from the technical viewpoint, it is, however, necessary that the graphite segments be in clamping positions possibly not required during operation so that improvements are possible with regard to costs.

OBJECT OF THE INVENTION

The object of the present invention is to provide an electrode assembly for electric arc furnaces capable of being clamped for support within the furnace at variable position along the axis of the electrode, without significant risk of breakage to the graphite segments or lengthy interruptions of furnace operations, while only a relatively small number of graphite segments are required at the same time.

SUMMARY OF THE INVENTION

The present invention provides an electrode assembly for arc furnaces, comprising an electrode, a clamping means for the electrode including at least one opening, spacing means arranged between the electrode and the clamping means; the electrode having an upper shaft surrounded by said spacing means, the spacing means including a substantially cylindrical supporting structure having lateral openings, and electrically conductive contact elements radially movable arranged with said lateral openings; said spacing means being arranged within the openings; said spacing means being arranged within the opening of the clamping means, the clamping means including clamping jaws configured to apply radial pressure upon said contact elements which thereby are pressed against the upper shaft.

DETAILED DESCRIPTION OF THE INVENTION

In preferred embodiments the lateral openings or apertures are slots which are parallel to the axis of the supporting structure. Generally, the electrode assembly will include at least three such slots that may include a plurality of cross pieces subdividing the said slots into individual orifices with each orifice being configured to receive a contact element.

The supporting structure comprises a fixation means to engage the spacing means with the clamping means, as to secure the spacing means to the clamping means in a manner independently from the electrode and allow relative movement between the electrode and the spacing means.

Frequently the contact elements are comprised of graphite; while the supporting structure consists of a metal.

In equally preferred embodiments the electrode assembly includes a top flange and a bottom flange interconnected by spacers which are parallel to the axis of the supporting structure and which are separated from each other so as to define said slots. A radial dimension of the spacers in such embodiments is generally smaller than a radial dimension of corresponding contact pieces received within the slots to properly abut on the upper shaft of the electrode. Frequently the contact elements on the spacers in such embodiments may be positively interlocked one to the next.

A plurality of contact element components may be inserted into each slot, which results in improved durability and better security against breakage.

The above and other features and advantages of the invention will become more apparent when considered in conjunction with the drawings and a description of the preferred embodiment of the invention which follow, together forming a part of this specification.

BRIEF DESCRIPTION OF THE DRAWINGS

The invention will be more readily understood in connection with the accompanying drawings in which.

DETAILED DESCRIPTION OF THE DRAWINGS

Figure 1:
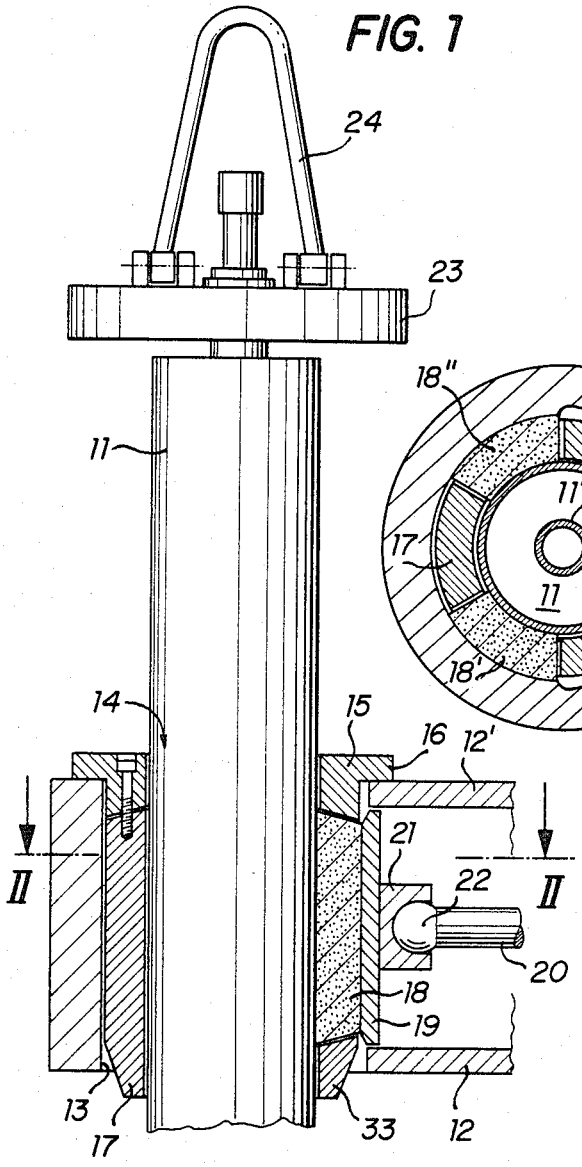
FIG. 1 is a side elevation view of an electrode assembly in accordance with the invention partially in cross section.

Referring to the drawings, FIG. 1 depicts an upper shaft (11) of an electrode for arc furnaces held by a clamping means or electrode support arm (12). The clamping means defines a cylindrical bore (13), in which the spacing means (14) is located.

A ring flange (15) is screwed on top of the top of the spacing means. This flange has two or more peripherical projections (16) the outside diameter of which is greater than the diameter of the bore (13). In this way it is possible to hang the spacing means (14) within the bore (13). The spacing means (14) has a cone-shaped chamfer on its bottom edge, which is to facilitate insertion into the bore (13).

The spacing means (14) basically comprises a supporting structure consisting of a top flange (15) and a bottom flange (33) which are connected by spacers (17) which define slots between each other. These slots contain contact elements (18) of graphite. Clamping jaw (19) press these contact elements (18) against the electrode shaft (11).

A fastening device or lever (20) is connected to the clamping jaw (19) in a movable manner by means of a ball-and-socket joint (21, 22). The clamping force pressing the lever (20) towards the electrode shaft (11) is produced e.g. by a hydraulic cylinder or by spiral springs, (not shown) in a suitable or conventional manner. The lever (20) and the ball-and-socket joint (21, 22) are arranged within a support arm which includes top and bottom members (12 and 12'). In this manner the joint (21, 22) will be protected from pollution.

At its upper end, the electrode has a slide-through preventer in the form of a crossbar (23) to which a holding bow (24) is affixed. This holding bow permits the axial movement of the electrode, i.e. it may be raised or lowered.

One advantage offered by the capability for clamping the electrode at various positions along the length of the electrode shaft (11) is the extension of the operable range of the electrode support arm.

Figure 2:
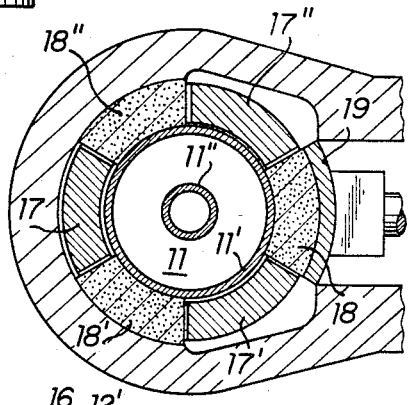
FIG. 2 is a transverse horizontal section of the assembly taken on line II—II in FIG. 1.

FIG. 2 shows a transverse horizontal section of the electrode assembly illustrated in FIG. 1 taken on line II—II of FIG. 1. In this section view, the spacing means comprises three spacers (17, 17', 17''), which are evenly distributed on the periphery and which define lateral openings which are parallel to the axis. Within these lateral openings are placed three contact elements (18, 18', 18''). The lateral contours of the contact elements (18 to 18'') have a smaller diameter than the internal contours of the spacers (17 to 17''). In clamped position, the contact elements (18 to 18'') are in direct contact with the cylindrical surface of the upper shaft (11) of the electrode. The electrode may be of the conventional type, i.e. a column consisting of graphite elements which may be screwed together, or it may be a combination electrode with a metallic upper part and a consumable lower part. A metallic type of electrode is schematically illustrated in FIG. 2 by two concentric metal pins (11' and 11''), cooling water passing down the inner pipe (11'') and up again through a ring or annular space produced by the two pipes (11', 11'').

The clamping jaw (19) is radially aligned with the contact element (18) and it is pressed against the electrode outer pipe (11') in the manner illustrated in FIG. 1.

In order to transfer a clamping force to the contact elements (18 to 18'') and further to the electrode, and contact elements (18 to 18''), which generally consists of graphite, have to be radially movable between the spacers (17 to 17'') but only by such a distance as required to guarantee a sufficient difference between the clamping and the releasing position. As the electrode is not compressible, a relatively small distance is typically sufficient.

Figure 3:
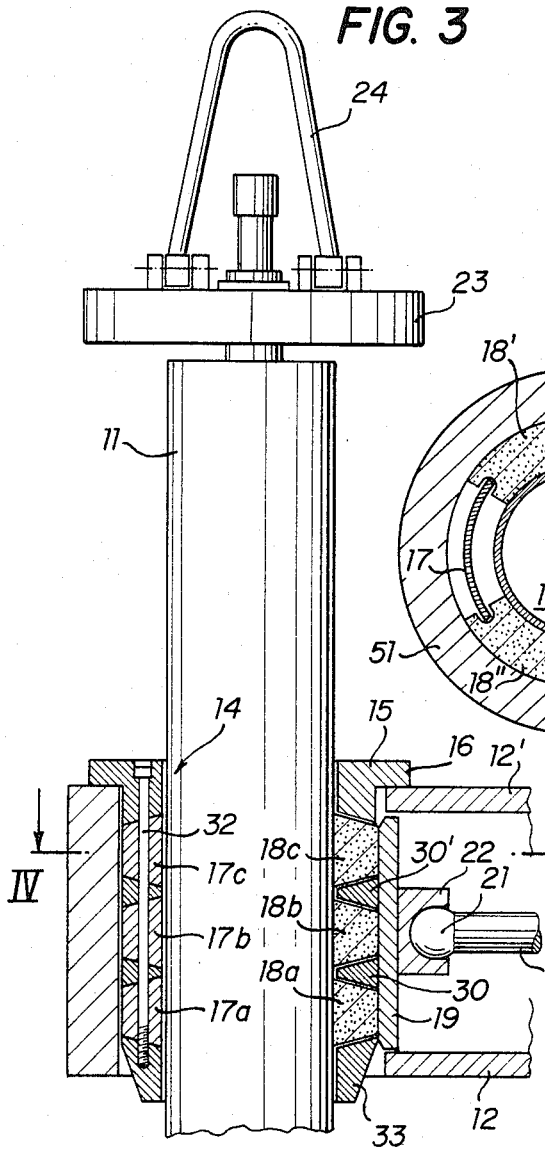
FIG. 3 is a side elevation view in partial cross section including an alternate embodiment of the contact elements and the supporting structure.

FIG. 3 illustrates an electrode analogous to that of FIG. 1 with the exception of the spacing means (14), with the contact elements consisting of axially separated components (18*a*, 18*b*, 18*c*), which are separated by spacer rings (30, 30') intersecting the spacers so as to form spacer sections (17*a* to 17*c*). The contact element (18) of FIG. 1 is subdivided into three segments (18*a* to 18*c*) which are separated by the spacer rings (30 and 30'). The spacer sections (17*a* to 17*c*) are connected by bolts (32) leading from the top flange (15) to the bottom flange (33).

Alternatively, the spacers (17) may consist of one piece and the spacer rings (30 and 30') may be intersected from segments.

To complete the spacing means (14), three sets of spacer sections (17*a* to 17*c*) are mounted on the bottom flange (33), with the contact components (18*a* to 18*c*) being arranged in between them. The spacer rings (30 and 30') are optional. Then the top flange (15) is put on the spacers sections (17*c*) and fastened thereon so that at least the contact element components (18*a* to 18*c*) remain movable to a certain extent.

On account of the dovetail-like shape of the spacer elements (17*a* to 17*c*) and contact element components (18*a* to 18*c*) and of the spacer rings (30, 30'), as shown in FIG. 3, the contact elements components (18*a* to 18*c*) are self supporting during the assembly of the spacing means (14). A design configuration according to FIG. 3 prevents the spacer elements (17*a* to 17*c*) from falling out of the supporting structure, while an additional configuration according to FIG. 2 prevents the elements from falling into the supporting structure. For an analogous reason, the contact element components (18*a* to 18*c*) may be laterally profiled to faciliate engagement of the spacer elements (17*a* to 17*c*), as shown in FIG. 4.

The spacer rings (30, 30') as well as the spacer segments (17*a* to 17*c*) incorporate bores which receive the bolts (32). Alternately the spacer segments (17*a* and 17*c*) (17*a* to 17*c*) may be simply bent at the top and at the bottom and then directly fastened to the flanges (15, 33) by bolts or other connecting means.

Figure 4:
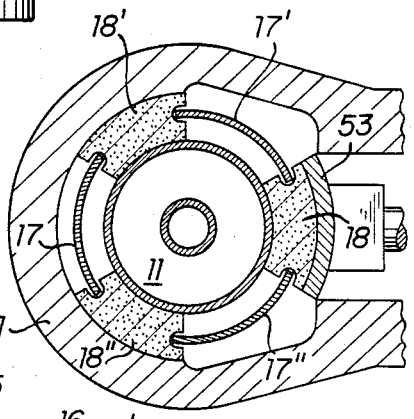
FIG. 4 is a sectional view of the electrode of FIG. 3 taken on line IV—IV of FIG. 3.

FIG. 4 shows a section view of an assembly in which the contact elements (18, 18', 18'') and the spacers (17, 17', 17'') are analogous to FIG. 2. The spacers 17, 17'and 17'') typically can be made from sheet metal bent on the top and at the bottom and mounted to the flanges by means of screws or the like.

The sides of the contact elements (18 to 18'') have axial grooves for the engagement of the spacers (17 to 17''). In accordance with a preferred embodiment of the invention a plurality of contact elements (18 to 18'') without spacing means (17 to 17'') are arranged one above the other to fill the space between the two flanges. Then instead of spacers (17 to 17'') made from sheet metal, bars may be employed in pairs positioned in the grooves of the contact elements (18 to 18'').

On the side of the electrode (11), the electrode support arm has a ring (51) on whose internal contour the contact elements (18 to 18'') rest snugly. A known device for the transmission of force (not shown) presses a clamping jaw (53) against the contact elements (18 to 18'') which transmit the force to the electrode (11) to provide clamping.

While a preferred embodiment of the invention has been shown and described in detail, various modifications and alterations may be made thereto without departing from the scope of the claims that follow.

What is claimed is:

1. An electrode assembly for arc furnaces comprising:

(a) an electrode shaft;

(b) clamping means surrounding said electrode shaft but spaced apart therefrom, said clamping means being positioned around a portion of the length of said shaft, with said clamping means including a clamping jaw configured for application of radial pressure;

(c) spacing means around the circumference of said shaft, arranged between the electrode shaft and the clamping means, said spacing means comprising spacer segments having lateral openings between adjacent segments; and (d) electrically conductive contact elements, radially movable for contact with said electrode shaft, arranged within said lateral openings and at least in part in contact with said clamping jaw;

whereby application of radial pressure from said clamping jaw upon said contact elements presses said elements, and clamps said elements against said electrode shaft.

2. The electrode assembly of claim 1, wherein the spacing means comprise a fixed ring means engaging the clamping means.

3. The electrode assembly of claim 1 or 2, wherein said lateral openings are slots which are parallel to the axis of said electrode shaft.

4. The electrode assembly of claim 3, wherein a plurality of cross pieces subdivide said slots into several individual orifices, each individual orifice being configured to receive a contact element.

5. The electrode assembly of claim 1, wherein the contact elements consist of graphite.

6. The electrode assembly of claim 1, wherein the spacer segments consist of metal.

7. The electrode assembly of claim 1, wherein spacing means comprises a top flange and a bottom flange with said spacer segments being parallel to the axis of the electrode shaft and interconnecting said flanges, said spacer segments being spaced apart one from another, thereby defining said lateral openings, and the radial dimension of each spacer segment is less than the radial dimension of each contact element.

8. The electrode assembly of claim 7, wherein the contact elements and the spacer segments are pressed against one another in clamped position.

9. The electrode assembly of claim 3, wherein a contact element is positioned in each slot.

10. A furnace electrode clamp comprising:

(a) clamping means surrounding a shaft of an electrode but spaced apart therefrom, said clamping means being positioned around a portion of the length of said shaft, with said clamping means a including clamping jaw configured for application of radial pressure:

(b) spacing means around the circumference of said shaft, arranged between the electrode shaft and the clamping means, said spacing means comprising spacer segments having lateral openings between adjacent segments; and (c) electrically conductive contact elements, radially movable for contact with said electrode shaft, arranged within said lateral openings and at least in part in contact with said clamping jaw;

whereby application of radial pressure from said clamping jaw upon said contact elements presses said elements, and clamps said elements against said electrode shaft.

* * * * *